United States Patent [19]

Baldassin

[11] Patent Number: 4,721,633

[45] Date of Patent: Jan. 26, 1988

[54] PROCESS FOR MANUFACTURING SPECKLED DETERGENT COMPOSITION

[75] Inventor: Carol A. Baldassin, Smithtown, N.Y.

[73] Assignee: Colgate-Palmolive Company, New York, N.Y.

[21] Appl. No.: 899,464

[22] Filed: Aug. 22, 1986

[51] Int. Cl.[4] ..... B05D 7/00

[52] U.S. Cl. ..... 427/212; 252/174.23; 252/174.24

[58] Field of Search ..... 427/212; 252/174.23, 252/174.24

[56] References Cited

U.S. PATENT DOCUMENTS

| | | | |
|---|---|---|---|
| 3,509,059 | 4/1970 | Renold | 252/174.2 X |
| 3,989,635 | 11/1976 | Toyoda et al. | 427/212 X |
| 4,162,228 | 7/1979 | Robles | 427/212 X |

*Primary Examiner*—Michael R. Lusignan

*Attorney, Agent, or Firm*—B. Lieberman; M. M. Grill; H. S. Sylvester

[57] ABSTRACT

A process is described in which a particulate detergent composition which is speckled in appearance is made by spraying an aqueous coloring medium, such as dye solution, containing polyacrylic acid, onto the surface of a moving bed of detergent composition particles containing an alkaline builder, thereby forming a coherent colored surface section or "skin" of detergent composition particles. The coherent section or skin of particles is next broken up and the colored particles are mixed with uncolored particles from the bed to make the speckled detergent composition. Normally, the bed of detergent composition particles is on a moving conveyer belt, which conveyer belt is preferably a weigh-belt, and the amount of coloring medium being sprayed onto the moving bed is automatically regulated by the weight of detergent composition particles on the belt passing under the spray nozzle(s), and the belt speed. It is an important feature of the described process that the aqueous coloring medium colors only a top portion of the particles in the moving bed and yet, such coloring of such particles is complete, with few, if any, uncolored areas on any of the colored particles. Also important is the quick reaction of the polyacrylic acid with the alkaline component(s) of the detergent composition beads, to form a polyacrylate coating on each of the beads, which holds moisture from the spray solution, so that drying is not required, and also acts to seal the surfaces of the colored particles and hold the colorant in the particles, inhibiting migration of colorant from the colored particles to contacting uncolored particles during transportation and storage of the speckled detergent compositions.

11 Claims, 4 Drawing Figures

PROCESS FOR MANUFACTURING SPECKLED DETERGENT COMPOSITION

This invention relates to the production of speckled detergent compositions. More particularly, it relates to a novel, continuous process for manufacturing such speckled detergent compositions wherein a coloring medium, preferably an aqueous solution of a dye, is sprayed onto uncolored spray dried detergent composition particles. Among important features of the invention are: (1) the coloring medium is employed to color only a part of a moving bed of detergent composition particles; (2) due to the presence of polyacrylic acid in the coloring medium the colored particles made have the colorant of the coloring medium sealed in them so that they do not bleed colorant onto contacting uncolored particles of the speckled detergent composition during transportation and storage; and (3) the colored particles made do not have to be air dried after manufacture.

Spray dried built synthetic organic detergent compositions have been commercially marketed in the United States for about 50 years and speckled detergent compositions, wherein some of the particles or beads have been intentionally colored so as to stand out from a white background, have been manufactured and sold at various times during the last twenty years. Initially during that period, such speckled detergent compositions were made by coloring uncolored detergent composition particles and then blending them with other such uncolored particles. Such products and such a process are described in Canadian patents 577,478 and 577,479. In another process, described in U.S. Pat. 3,357,476, a colored aqueous detergent composition crutcher mix is spray dried in a spray tower that is simultaneously employed for spray drying an uncolored crutcher mix, with the result that the dried product mixture removed from the spray tower bottom is of speckled appearance, containing some colored particles in a background of uncolored particles. In a variation of such process colored or uncolored crutcher mixes are sequentially sprayed through the same spray nozzle(s) into a spray drying tower, so that a speckled particulate detergent composition results (U.S. Pat. No. 3,592,254). In U.S. Pat. No. 3,035,301 and British patent specification 1,546,139 there are described processes for simultaneously agglomerating and coloring uncolored detergent composition particles or components to make colored speckles, which are then mixed with similar uncolored particles to produce a detergent composition of speckled appearance.

Of the prior art processes of which the present inventor is aware, as a result of a search made prior to the preparation of this application, that which is considered to be most relevant to the present invention is U.S. Pat. No. 4,434,068, which describes a process for making colored detergent composition speckles for addition to spray dried uncolored detergent beads to produce a particulate detergent composition of speckled appearance, by spraying onto spray dried, uncolored detergent composition beads, a colorant solution which contains a hydratable salt. By this process, when the colorant solution is sprayed onto the uncolored particulate detergent beads, a solid hydrate of the salt forms, thereby removing water from the colorant solution and facilitating use of the colored particles (by addition thereof to uncolored particles to make a speckled composition) without the need for intervening heat drying to remove from the colored particles the water that accompanied the colorant and hydratable salt. In short, by the process of U.S. Pat. No. 4,434,068 one is able to make colored detergent speckles by spraying onto detergent particles an aqueous solution of a dye, without having to heat dry the colored particles so made, and without the need for a comparatively lengthy "curing" or "conditioning" period after coloring, which conditioning otherwise is usually effected in a mixing or agglomerating apparatus in which coloring of the detergent composition particles took place. However, for best results by the process of U.S. Pat. No. 4,434,068, the salt employed must be one which is capable of a high degree of hydration and a substantial proportion thereof must be present in the coloring medium; the patent recommends employment of a nearly saturated (with respect to the hydratable salt) solution, and more preferably, such solution should be supersaturated. Also, the process of U.S. Pat No 4,434,068 is not an automatic one and is only directed to the manufacture of the colored speckles. Thus, to make a speckled detergent composition the colored speckles must then subsequently be blended with uncolored (or differently colored) detergent composition beads.

The process of the present invention represents a significant advance over the process of U.S. Pat. No. 4,434,068, in that the inventive process can be (and usually is) automatic, the colored speckles made are colored in the presence of uncolored speckles, which uncolored speckles comprise the balance of the speckled detergent composition, the colored speckles are made without the need for employing a coloring medium comprising a relatively high percentage of hydratable salt, and the colored speckles made are resistant to breakage, disintegration and powdering, and do not transfer colorant to contacting uncolored particles during transportation and storage, which is considered to be due to the presence of polyacrylate at the surfaces of such colored particles.

In accordance with the present invention a process for manufacturing a particulate detergent composition, which is speckled in appearance, comprises spraying a surface of a bed of alkaline detergent composition particles with an aqueous coloring medium comprising water, colorant and polyacrylic acid, so that the coloring medium colors less than 10% of the particles and penetrates less than 10% of the distance through the bed of particles, whereby a coherent colored surface section of detergent composition particles is formed, and breaking up such colored surface section and mixing the colored particles therefrom with the uncolored particles. In preferred embodiments of the invention the aqueous coloring medium comprises an anthraquinone dye (because such dye is less substantive to laundry being washed and does not stain it), propylene glycol (to strengthen the color of the colored speckles), water, and polyacrylic acid of a molecular weight in the 40,000 to 80,000 range, preferably being about 60,000, which components are present within listed ranges of proportions for satisfactory, more desirable and best activities. Also preferably, the colored speckles are made by spraying the top layer or so of uncolored spray dried built detergent composition particles in a bed moving on a conveyer belt which is equipped with a weigh-belt, which is a weighing mechanism for the material being conveyed by the belt, a control means for varying the volume of coloring medium being pumped to a spray nozzle, and a flat jet spray nozzle or a plurality of such nozzles for spraying colorant solution or coloring medium onto the bed of spray dried detergent composition beads on the moving belt. In such preferred embodiment of the invention the apparatus employed automatically controls the application of the coloring medium spray onto the bed of detergent particles, to produce the right proportion of speckles for the speckled detergent compositions desired.

The detergent compositions of this invention may be any such compositions in particulate form, although it is preferred to employ those that are spray dried or agglomerated, and subsequently screened to desired size range, because of the greater uniformity of particle sizes and shape, which sizes will usually be in the range of No's. 8 to 120, U.S. Sieve Series, preferably No's. 10 to 100, and more preferably about 20 to 80, with the shape thereof preferably approximating the spherical. However, although the invention is primarily directed to a process for manufacturing speckled detergent compositions, it is also applicable to manufacturing other speckled particulate products, such as decorative wood, mineral or synthetic polymeric "plastic" particles, providing such are sufficiently sorptive and alkaline enough to neutralize the polyacrylic acid in the coloring medium.

For the making of speckled detergent compositions the detergent may be a soap (water soluble metal salt of a mixture of higher fatty acids, usually obtained from vegetable and animal fats and oils) or a synthetic organic detergent, or any suitable mixture thereof. The soap is usually preferably the sodium soap of a mixture of tallow and coconut oil fatty acids and is made by saponification of such a fat-oil mixture with lye. The synthetic organic detergent may be any suitable such detergent, which usually will be anionic, nonionic, amphoteric, ampholytic or zwitterionic, or a mixture of two or more of such types of detergents. Preferably such synthetic organic detergent will be an anionic detergent or a nonionic detergent or a mixture thereof. The anionic detergents will usually be sulfated or sulfonated detergents, which may be designated sulf(on)ated, and which will normally contain a lipophilic group or moiety which includes a higher alkenyl or alkyl (usually of 8 to 20 carbon atoms). Among such sulf(on)ated detergents are the higher fatty alcohol sulfates, higher fatty alcohol ethoxylate sulfates, higher alkylbenzene sulfonates, higher fatty acid monoglyceride sulfates, olefin sulfonates, paraffin sulfonates, N-lower alkyl N-higher fatty acyl taurates, and higher fatty acid esters of isethionic acid. Such anionic detergents are preferably employed as their alkali metal salts, e.g., sodium salts. Of the nonionic detergents the condensation products of higher fatty alcohols (of 8 to 20 carbon atoms) and ethylene oxide are preferred, in which the ethylene oxide content may be from 1 to 30 moles per mole of higher fatty alcohol, preferably of 3 to 15 moles of ethylene oxide. Also useful are various alkyl phenoxypolyethoxy ethanols, such as those sold under the trademark Igepal®. Among the amphoteric materials are the betaines and sulfobetaines, such as coco amide betaine, coco betaine and tallow betaine, sold under the trademark Miranol®, and the corresponding sulfobetaines. Among the zwitterionic compounds are the higher alkyl betaaminopropionic acids. When amphoteric, ampholytic or zwitterionic detergents are employed they normally will constitute only a minor proportion of the synthetic organic detergent content of a detergent composition, with the balance thereof normally being anionic and/or nonionic detergent(s).

Various builders and combinations thereof which are effective to complement the washing action of the soap and/or synthetic organic detergent(s) may be employed, including both water soluble and water insoluble builders. Among the water insoluble builders are the zeolites but for the purposes of the present invention it is preferred to employ water soluble builders. Of these, those which best react with the polyacrylic acid of the coloring medium are the salts of weak acids and strong bases, such as sodium salts. Representative of the preferred builders are the various phosphates, usually polyphosphates, such as tripolyphosphates and pyrophosphates, e.g., sodium tripolyphosphates and sodium pyrophosphates, specifically pentasodium tripolyphosphate and tetrasodium pyrophosphate; sodium carbonate, sodium bicarbonate, sodium sesquicarbonate, sodium silicates, and mixtures thereof. Additionally, water soluble organic builders may be utilized, such as sodium nitrilotriacetate, sodium citrate, sodium gluconate, sodium ethylenediamine tetraacetate and sodium iminodiacetates. Instead of the sodium salts, other water soluble salts may be utilized, including potassium salts, but it normally will be preferred to avoid employing ammonium or amine salts. Various adjuvants may be in the detergent compositions (and in the colored speckles), including: fabric softeners, such as bentonite; quaternary ammonium halides; fluorescent brighteners, such as the distilbene brighteners; enzymes, such as proteolytic, lipolytic and amylolytic enzymes; antiredeposition agents, such as sodium carboxymethyl cellulose; whitening agents, such as titanium dioxide; flow promoting agents, such as synthetic calcium silicate (Microcel® C); and perfumes. Fillers, such as sodium sulfate, may also be present.

The basic particulate detergent composition, normally uncolored or white, may be made in any suitable manner, including conventional spray drying or agglomeration techniques. When nonionic detergent-based detergent composition particles are to be made, the nonionic detergent may be post-sprayed onto previously spray dried builder particles, which builder particles may have a portion or all of the heat stable adjuvants and filler contents thereof present in the same crutcher mix as the builder salt(s). Normally any perfumes and enzymes in the formula or other heat sensitive materials will be post-added to the speckled detergent composition or to a portion thereof after spray drying or other subjection to higher temperature conditions, and flow promoting adjuvants are also often post-added.

Normally the synthetic organic detergent and/or soap content of the synthetic organic detergent beads will be from 5 to 35%, preferably 10 to 30% and more preferably 15 to 25%, and the builder content will be from 10 to 80%, preferably 20 to 60% and more preferably 25 to 50%. The adjuvant content will normally be in the range of 3 to 25%, preferably 5 to 15%, and the contents of individual adjuvants will be in the range of 0.1 to 5%, as a rule. Filler content can be from 0 to 60%, preferably 5 to 60% and more preferably 10 to 50%. The water content of the product (all particulate detergents contain some water) will normally be in the range of 2 to 15%, preferably being in the range of 2.5 to 11, for example, 3% or 9%.

The coloring medium is an aqueous medium and normally the major component thereof is water. In such coloring medium the colorant employed is a dye or a water dispersible pigment. Of the dyes, the anthraquinone dyes are preferred when substantivity to washed laundry is undesirable, but in those instances where substantive action is unobjectionable or is desired, phthalocyanine dyes or pigments are preferred. Examples of suitable dyes, depending on the types of products desired, are the acid stable phthalocyanine blue dye identified as CI Acid Blue 185, which is sold by CIBA Geigy Corp., the anthraquinone dyes identified as CI Acid Blue 80 (ammonium and sodium salts), which are sold by CIBA Geigy Corp. and the anthraquinone dye identified as CI Acid Blue 182, which is sold by Sandoz, Inc. Instead of one of the mentioned dyes, other suitable dyes of different colors and/or different chemical types may also be used and there may be employed water dispersible pigments, such as that sold under the name Monastral blue, but care should be taken to avoid utilizing any dyes or pigments which decompose in contact with the polyacrylic acid and detergent beads to release unpleasant odors, such as those of sulfur or ammonia.

The polyacrylic acid employed will preferably be of higher molecular weight, normally being of a weight average molecular weight in the range of 10,000 to 100,000, preferably 40,000 to 80,000 and more preferably about 60,000. It has been found that the most preferred of such materials (as the sodium salt) satisfactorily binds water, forms a strengthening coating on the detergent bead, which helps to make it free flowing, and inhibits weeping or bleeding (migration) of color from the colored speckles onto contacting surfaces of uncolored detergent composition beads.

Another preferred component of the coloring medium or dye solution is propylene glycol, which has been found to act to strengthen the dye color in the speckles. The phthalocyanine dyes and pigments are acid stable and so do not react objectionably with the polyacrylic acid. The anthraquinone dyes are not as stable and do react to some extent with polyacrylic acid, whereby the dye color is somewhat weakened; therefore, it is desirable to employ more propylene glycol in the anthraquinone dye solutions than in the phthalocyanine dye solutions and pigment dispersions.

The proportions of the various components of the coloring medium are such that the water soluble dye or water dispersible pigment sufficiently colors the detergent speckles so that such speckled particles, when mixed with uncolored detergent particles, give the appearance of a speckled particulate detergent. While such proportions will be different for various dyes and color effects desired, normally 10% are accepted as the outside limits on the proportions of dye or pigment present, with 0.5 to 5% being the normal range and 0.6 to 2.5% being preferred. The proportion of polyacrylic acid will be within the range of 0.5 to 15%, preferably 2 to 10% and more preferably about 4%, e.g., 3.75%. The percentage of propylene glycol, if present, will normally be within the range of 1 to 5%, e.g., about 2% for acid stable dyes, and about 4% for those which may react somewhat with the polyacrylic acid. The water content of the coloring medium will be in the range of 70 to 98%, preferably 80 to 96.5%, more preferably 90 to 94%, e.g., 90% or 92%.

The invention will be readily understood by reference to the following description thereof, taken in conjunction with the preceding material and the drawing in which.

Figure 1:
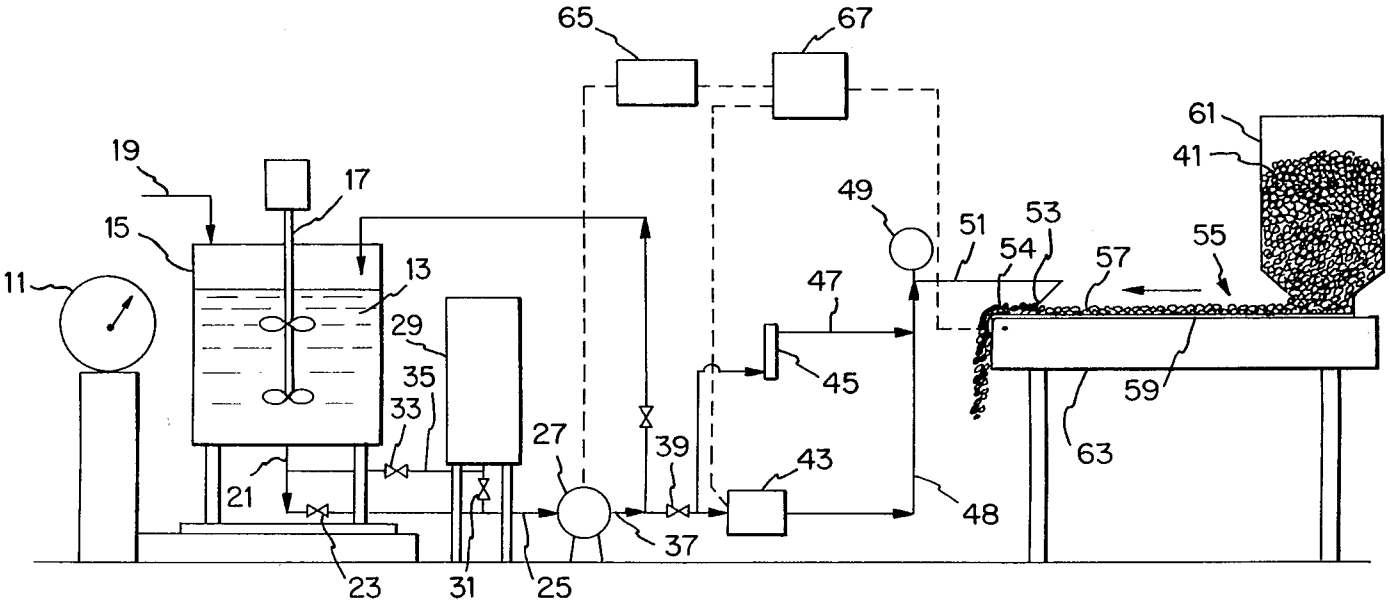
FIG. 1 is a schematic side elevational view of an apparatus for effecting the process of this invention.

In FIG. 1, scale 11 is employed to weigh various components of the coloring medium 13, shown in making tank 15, which is equipped with stirrer 17. Inlet line 19 represents piping for addition of water to the mixing tank. Outlet line 21 allows delivery of the coloring medium through valve 23 and line 25 to pump 27 or to hold tank 29 through valve 31. Valve 33 and line 35 also interconnect making tank 15 and hold tank 29. Low pressure pump 27 delivers the liquid coloring medium through line 37 and valve 39 to mass flow meter 43 and to rotameter 45 and thence through lines 47 and 48 under pressure, which is measured by pressure gauge 49, through line 51 to spray nozzle or nozzles 53 and onto bed 55 of detergent particles 57 on conveyer belt 59, which is a weigh-belt. Instead of the liquid coloring medium being directed to spray nozzle(s) 53 from pump 27, alternatively it may be recycled to making tank 15. Surge bin 61 contains uncolored detergent composition beads which are being fed onto conveyer belt 59, which is moving in the direction of arrow 63. The volume of liquid coloring medium (and hence, of course, the weight thereof) and the weight of detergent composition beads fed to belt 59 are automatically regulated by pump speed controller 65 and weigh-belt controller 67, respectively. The weigh-belt controller measures the feed rate of the detergent composition beads from the belt speed and weight) and controls the pump speed controller, which regulates the volume and weight of liquid coloring medium fed to spray nozzle 53.

The spray of liquid coloring medium colors essentially only the top layer of detergent composition particles and the polyacrylic acid in the coloring medium (preferably dye solution) almost instantly converts the top layer of detergent composition particles into a colored "skin" or coherent upper layer 54 of such particles. As such layer, together with the uncolored, unattached particles below it on the conveyer belt, fall off the belt, the coherent upper layer breaks apart, due to strains to which it is subjected, and the fragmented upper layer and the uncolored beads are both delivered, directly or indirectly, to a tumbling drum, as is illustrated in FIG. 4.

Figure 2:
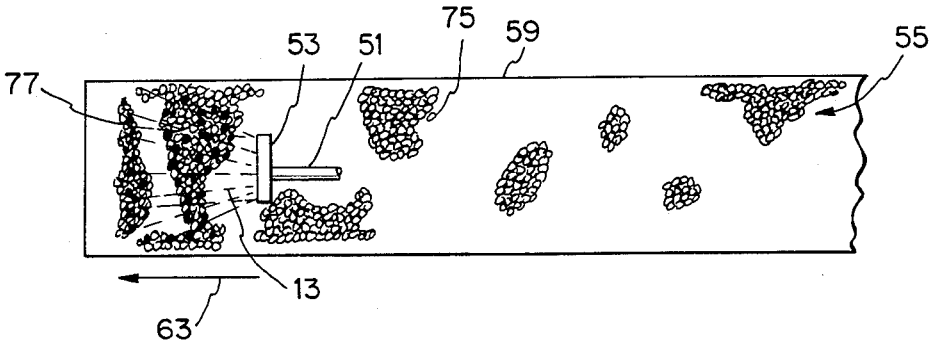
FIG. 2 is a top plan view of the spraying of coloring medium onto the surface of a bed of uncolored detergent composition beads, while such bed is being moved along a conveyer belt of the weighing type.

In FIG. 2 conveyer belt 59 has on it a continuous bed 55 of detergent composition beads, which, for convenience, are only partially shown in the drawing figure. Conveyer belt 59, which is being viewed from above, is moving in the direction indicated by arrow 63. Nozzle 53 is connected to pump 27 by line 51 and liquid medium 13 is shown being sprayed through nozzle 53 onto the top of bed 55 of uncolored beads 75. The spray of coloring liquid 13 does not extend to the outermost of beads 75 of bed 55 on belt 59, and therefore the spray does not contact the belt and does not drip off it. Colored detergent composition beads 77, shown downstream of spray nozzle 53, form a coherent layer or section 54, better illustrated in FIG. 3.

Figure 3:
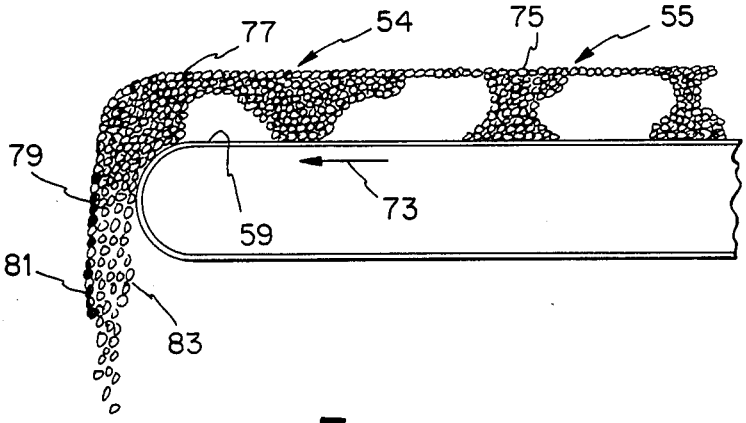
FIG. 3 is an enlarged side elevational view of the bed of detergent composition beads on a conveyer belt, showing the coherent colored surface section or colored "skin" at the top of the bed.

In FIG. 3, which is an enlarged fragmentary elevational view of a bed 55 of uncolored detergent beads 75 and colored detergent beads 77 (that form a skin 54), the essentially one bead thick colored surface section or skin 54 of the bed is shown, as is the breaking apart of such section into fragments 79 and 81 as the bed falls off the end of the belt 59 and the uncolored beads separate into individual beads 83.

Figure 4:
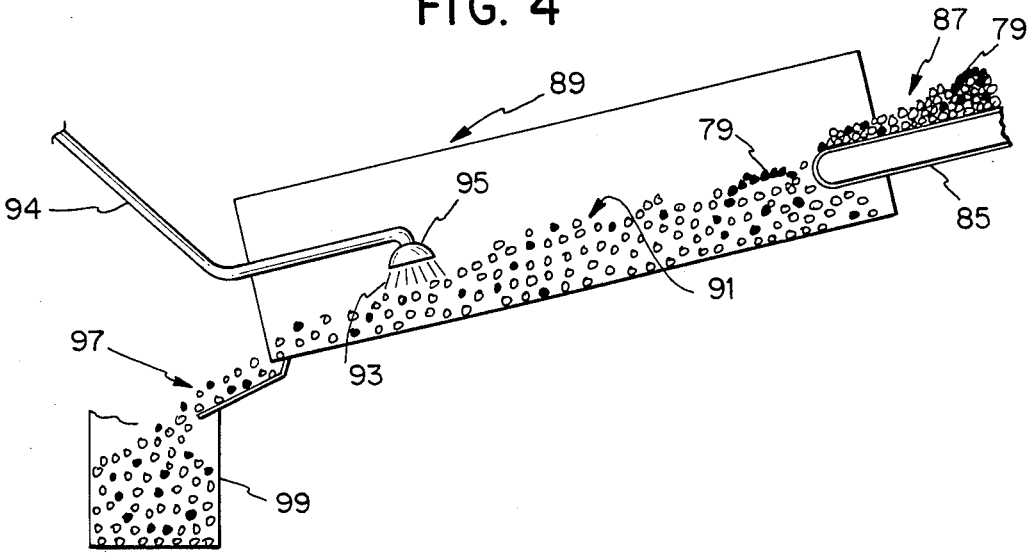
FIG. 4 is a schematic side elevational view of a perfuming drum wherein the speckled detergent composition from the conveyer belt is broken up, mixed and perfumed.

FIG. 4 illustrates the delivery, by conveyer 85 or other suitable means, of the mixed colored and uncolored detergent composition particles which include some "skin" sections 79 of colored particles), which mixed particles are identified by numeral 87, to an inclined drum mixer 89, in which a moving bed of mixed colored and uncolored particles, identified by numeral 91, has perfume 93 sprayed thereon, which perfume is delivered to the particles through line 94 and spray nozzle 95. During movement through the inclined drum or tube 89 of the detergent composition beads and any fragments of a plurality or multiplicity of such beads held together in a coherent section 79, such sections are broken up into their component particles, so that the product 97 exiting from the inclined drum into container 99, from which it is fed to packaging equipment, not shown, is of speckled appearance, free flowing and non-bleeding.

By the process described above, in conjunction with FIG'S. 1–4, it is seen that a mixed-color, multi-colored, or variegated detergent composition of speckled appearance is made, with the coloring of a certain portion of the detergent composition beads thereof being effected automatically in such a way that the colored beads are strengthened and made non-bleeding by an automatic process which does not require frequent cleanings of the conveyer belt (because the belt is not wet by the coloring medium). Also, although a large excess of coloring medium is not employed to color the desirably colored particles of the speckled mixture such particles are completely colored, and the invented process is such that no drying of them is required. The water in the coloring solution or dispersion is absorbed by the alkali metal polyacrylate formed by reaction of the polyacrylic acid with the alkali metal builder salt(s) in the detergent composition beads and additionally, the heat of reaction may also contribute to removal, by volatilization, of some excess moisture. Furthermore, the presence of only a relatively small proportion of colored beads, which are subsequently tumbled in contact with uncolored beads, which uncolored beads have not had any additional water applied to them, may also act to remove some moisture from the colored material. Although the polyacrylic acid's main function is as a binder, binding the colorant to the detergent composition beads in a surprisingly effective way, it also acts to improve washing properties of the final detergent composition, in which it performs as a dispersing agent.

The invented process efficiently and automatically produces an acceptable speckled particulate detergent composition in a manner considered to be superior to prior art processes. The invented process has the additional advantages of being readily changeable so that different proportions of colored beads in the final composition may be produced by varying the width of the spray of coloring medium across the conveyer belt, by varying the spray pressure, and the color of the coloring beads may be changed relatively quickly by merely feeding a different coloring medium to the spray nozzle(s). A further advantage is in the ready adaptability of the process to conventional production lines for the manufacture of particulate detergent compositions. Conventional crutchers, spray towers, conveyers and perfuming drums may be employed, with the only additional equipment needed being the surge tank, conveyer, weigh-belt mechanism, making tank (for the coloring medium), variable delivery pump, spray nozzle and control mechanisms. Such equipment may be made as a portable unitary or combination item, which can be employed on any of a number of conventional particulate detergent production lines to convert such, as may be desired, to the production of speckled particulate detergent compositions.

During the spraying of the colorant medium onto the moving bed of detergent composition particles it will usually be desirable for the particles to be in a bed which is of a depth from 1 to 20 cm., preferably 5 to 15 cm., and a width from 25 to 100 cm., preferably 40 to 80 cm., e.g., 60 cm. The spray of colorant medium will normally penetrate into the bed of particles so far as to color and deposit on only the upper particles. The depth of penetration will normally be less than 10% of the depth of the bed of particles, preferably less than 5%, and in a typical satisfactory operation only the upper layer of particles (a single particle thickness in depth) will be colored and coated. The width of the spray of coloring medium may be regulated so as to produce final compositions of different extents of speckling, and desirably, the spray will not extend past the sides of the bed on the conveyer belt, thereby preventing dripping onto the belt of the coloring medium. Preferably, the width of spray will be no more than 95% of the bed width, such as 10 or 30 to 95%, and preferably 60 to 90% thereof, with the spray being centered so that the unsprayed edgings of the bed will be at least 2%, and preferably will be at least 5% of the particles bed width, preferably being at least 3 cm., and more preferably being at least 5 cm.

The spray pressure for spraying the coloring medium onto the bed of detergent composition particles on the conveyer belt is usually a relatively low pressure, generally in the range of 0.3 to 1.5 kg./sq. cm. but such pressure is not normally critical. It has been found that by varying the pressure, as by increasing it, and sometimes, by changing the direction of the spray, greater penetration than a single particle thickness may be obtained, which allows for a greater variation in the proportion obtainable of colored detergent particles in a speckled product. Normally, a spray nozzle capable of emitting a flat spray pattern will be desirable and such pattern will preferably extend over a major proportion of the bed width. A single nozzle may be employed or a plurality of nozzles, and when a plurality of nozzles is utilized they may be so directed as to promote penetration of the coloring medium into the bed or to limit such penetration to the top particles.

The weight of colorant medium sprayed onto the base detergent composition particles will normally be within the range of 0.1 to 5% of the weight of such particles, preferably 0.1 to 2% and more preferably 0.1 to 1%, e.g., about 0.2%, 0.4% or 0.6%, by weight. In the final product, the speckled detergent composition particles, about 0.2 to 5% of the beads will be colored, preferably 0.5 to 2%, and more preferably about 1%. Such proportions result in distinctively speckled appearing products, especially when the described dyes are empolyed, which are of desired hues, chromas and values.

The folloiwing examples illustrate but do not limit the invention, unless otherwise indicated all parts and percentages in the examples and in the specification and claims ae by weight and all temperatures are in ° C.

| Component | Formula 1A % (by weight) | Formula 1B % (by weight) | Formula 1C % (by weight) | Formula 1D % (by weight) |
|---|---|---|---|---|
| Water (deionized) | 80.3 | 79.0 | 79.6 | 81.0 |
| *Polyacrylic acid solution (25% polyacrylic acid in water) | 15.0 | 15.0 | 15.0 | 15.0 |
| Propylene glycol | 4.0 | 4.0 | 4.0 | 2.0 |
| CI Acid Blue 80 Dye, sodium salt | 0.7 | — | — | — |
| CI Acid Blue 80 Dye, ammonium salt | — | 2.0 | — | — |
| CI Acid Blue 182 Dye | — | — | 1.4 | — |
| CI Acid Blue 185 Dye | — | — | — | 2.0 |
| | 100.0 | 100.0 | 100.0 | 100.0 |

*(Molecular weight of 60,000)

The various dye solutions are made in the manner recited in the description of FIG. 1, with the dyes preferably being dissolved in the water, with mixing, before addition of the polyacrylic acid solution and propylene glycol. In some instances the propylene glycol may be omitted. In other cases, different dyes or water dispersible pigments may be employed but normally it will be preferred to utilize the anthraquinone dyes, eg., of Examples 1A, 1B and 1C, when substantivity on washed laundry is undesirable, and to employ the phthalocyanine dyes and water dispersible pigments (as of Example 1D) when such substantivity is unobjectionable. Commercial products that are useful in accordance with the present invention include anthraquinone dyes available from CIBA-Geigy Corporation, sold under the names Polar Brilliant Blue, CPS Blue (a special product) and CIBA Crolan 8G, and EHRL Sandulan Blue 180%, available from Sandoz Corporation. Various other dyes may be substituted for those mentioned, providing that they are capable of satisfactorily coloring the particulate product to be colored. Usually such dyes should be of a satisfactory hue, a strong chroma and a medium value, to produce an acceptable speckled product.

| Component | Formula 2A % (by weight) | Formula 2B % (by weight) |
|---|---|---|
| Sodium linear tridecylbenzene sulfonate | 15.7 | 16.3 |
| Sodium tripolyphosphate | 27.9 | — |
| Sodium sulfate | 33.32 | 14.21 |
| Sodium silicate ($Na_2O:SiO_2$ = 1:2.4) | 7.0 | 4.9 |
| Zeolite 4A | — | 23.3 |
| Sodium carbonate | — | 20.9 |
| Hydroxypropyl methylcellulose | 0.6 | 0.6 |
| Sodium polyacrylate | — | 2.0 |
| Sodium carboxymethylcellulose | 0.12 | 0.12 |
| Fluorescent brightener (Tinopal ® 5BM) | 0.18 | 0.17 |
| Water | 8.5 | 8.5 |
| Nonionic detergent (Neodol ® 25-7 [Shell Chemical Co.]) | 0.5 | 0.5 |
| Synthetic calcium silicate (Microcel ® C [Johns-Manville Corp.]) | 0.25 | 1.0 |
| Distearyldimethyl ammonium chloride (Arosurf ® MCV-8 [Sherex Corp.]) | 5.34 | 6.68 |
| Colorant medium (as described in the formulas of Example 1) | 0.35 | 0.35 |
| Perfume | 0.24 | 0.47 |
| | 100.0 | 100.0 |

The detergent compositions of Formulas 2A and 2B are made by conventional spray drying and post-addition techniques, except for the application to them of the colorant media. In both such cases, those indicated of the first ten listed components (ending with the fluorescent brightener) are made into an aqueous crutcher mix containing about 35% of water. Such mix, at a temperature of about 70° C., is pumped to a conventional spray tower by a high pressure pump, is atomized by passing it through spray nozzles in the tower, and is dried in a hot drying gas which enters the tower at a temperature of about 400° C., to produce spray dried beads of generally globular form, which are of particle sizes in the No's. 10 to 100 range, U.S. Sieve Series, or are screened to be in such range. The spray dried beads are of a moisture content of about 9%, after cooling to about room temperature.

The spray dried beads described are then delivered to a surge tank, such as that illustrated in FIG. 1, and are fed to a conveyer belt equipped with a continuous weighing mechanism. Colorant medium is sprayed in a flat spray onto the top of the bed of detergent particles formed on such belts, as illustrated in FIG'S. 1 and 2, and the detergent composition particles are removed from the belt, as shown in FIG. 3, and are fed to a perfuming or compounding inclined drum mixer, as illustrated in FIG. 4, or to another suitable mixer. Due to the formation of sodium polyacrylate on the surfaces of the beads coated with colorant medium, some water is "absorbed" by the polyacrylate and the composition does not have to be dried or cured before further treatments. In the drum mixer the distearyldimethyl ammonium chloride powder is added to the mixed colored and uncolored (or differently colored) detergent composition beads and the nonionic detergent, in liquid state, is sprayed onto such detergent composition beads. Meanwhile, the detergent composition beads and cohering colored skin sections are being tumbled, and such sections of colored particles are separated into individual beads. Then, the beads are perfumed, as illustrated in FIG. 4, and subsequently, the synthetic calcium silicate, which acts as a flow improving agent, is added to them.

The specific formulas given in this example are for fabric softening detergent compositions because those are the products that were employed in the testing of the present invention, but it is clear that various other types of detergent compositions, preferably based on spray dried detergent composition or spray dried builder beads, which compositions do not contain fabric softening components, may also be employed. Of the other detergents, anionics, such as sodium higher fatty alcohol sulfates, sodium ethoxylated higher fatty alcohol sulfates; nonionics, such as condensation products of higher fatty alcohols and ethylene oxide, e.g., Neodol 25-7; and amphoteric detergents, such as Miranols®; may be employed instead of or in addition to the alkylbenzene sulfonate detergent. Others of the previously named builders and adjuvants may be present, and certain adjuvants may be omitted. Because the post-added nonionic detergent, synthetic calcium silicate and quaternary ammonium halide may be omitted from the product, inlets, lines and spray nozzles for additions of such materials are not essential, and therefore are not illustrated in FIG. 4 of the drawing.

EXAMPLE 3

Eight different final detergent compositions of the formulas given in Example 2 (2A and 2B) are made, with each of the formulas being made with each of the four colorant media of Example 1. In such experiments 0.35% of the colorant medium (final product basis) is sprayed onto a bed of synthetic organic detergent particles of the formulas of Example 2 (those indicated of the first ten components), each of which contained 8.3 parts of water (8.9% and 9.1%, respectively for the 2A and 2B bed material formulas). The detergent particles are of sizes in the No's. 10 to 100 range, U.S. Sieve Series, and the bed is 10 cm. thick and approximately 60 cm. wide (the conveyer belt being about 75 cm. wide.)

The colorant media are individually sprayed onto conveyer belt beds of the two different particulate detergent composition formulas, through a single flat spray nozzle sold by Spraying Systems, Inc., which is their Unijet nozzle, Type T, No. 6503. The width of the spray is about 50 cm. or about 83% of the width of the bed of detergent particles, and the spray penetrates only a single layer of detergent composition beads and completely and uniformly covers the beads of such layer. It also causes the beads to form a coherent section or to adhere together to form a "skin" of coated colored particles on a bed of uncoated, uncolored particles. Such skin is broken into smaller sections as the particles fall off the conveyer belt, as is shown in the drawing. The speed of the belt and the volume (or weight) of colorant medium sprayed onto the bed of detergent composition particles are automatically regulated by the control mechanism illustrated in FIG. 1, so that the weight of colorant medium sprayed onto the detergent composition beads is about 0.4% of the weight of the beads or about 0.35% of the weight of the final product. The various compositions produced all appear to contain about 1% of colored particles and about 99% of uncolored particles and the colored particles are uniformly and completely colored, and stand out in the background of uncolored particles, giving the final product a speckled appearance. The presence of the distearyldimethyl ammonium chloride, the calcium silicate, the nonionic detergent, and the perfume do not appear to detract significantly from the desired speckled appearance.

Because in Examples 1 and 2 formulas of the colorant media and the final speckled detergent compositions, respectively, were given, it is considered to be superfluous to give the final composition formulas for each of the eight final products of the present example. Rather, reference is made to the formulas of Example 2 and in each of these there will be 0.03% of a mixture of polyacrylic acid, propylene glycol and specific dye employed (0.35% of colorant solution). Thus, if a 1A colorant medium is applied to the spray dried detergent beads of Formula 2A ahd the various post-added materials are also incorporated in such composition the 0.03% of non-aqueous colorant medium components will include 0.013% of polyacrylic acid, 0.014% of propylene glycol and 0.003% of CI Acid Blue 80 Dye, sodium salt.

For identification purposes the eight formulas of this example will be numbered as follows:

3A—1A colorant in 2A formula;
3B—1B colorant in 2A formula;
3C—1C colorant in 2A formula;
3D—1D colorant in 2A formula;
3E—1A colorant in 2B formula;
3F—1B colorant in 2B formula;
3G—1C colorant in 2B formula; and
3H—1D colorant in 2B formula.

All the products, 3A–3H, are of attractive speckled appearances. They are free flowing and the colored beads (or speckles) are harder and smoother on the surfaces thereof (due to the polyacrylate coating), and do not bleed blue colorant to uncoated beads in contact with them. The polyacrylate coating holds the colorant and also inhibits migration thereof into the bead interiors. The colored beads are strengthened by the polyacrylate coating and are less likely to be disintegrated during processing, transportation and use, making the speckled effect more stable, even when the uncolored background beads are broken in handling.

When the 3D and 3H products are employed at a concentration of 0.15% in wash water in an automatic washing machine to wash white laundry articles, it is found that the laundry is washed clean (it is considered that the polyacrylate made contributes to detergency and soil suspension), and after being dried in an automatic laundry dryer, it is soft and static-free. However, because the CI Acid Blue 185 Dye is substantive to cotton and other fibrous materials of the laundry sometimes the washed laundry appears spotted, which is undesirable. In similar washings, wherein the same proportion of the other detergent compositions of this example is employed, the laundry is washed clean, after automatic laundry drying it is soft to the touch and static free, and it is not objectionably colored or spotted.

In variations and modifications of the invention different dyes and water dispersible pigments, such as that sold under the name Monastral Blue, may be substituted for the other colorants of Example 1. Also one may employ a plurality of nozzles and separate differently colored dye media to be sprayed on different portions of the powder bed if a detergent composition with two or more colored speckles is desired. In some instances the propylene glycol can be omitted because there will be no need for its brightening action on a dye. Anionic detergent compositions based on sodium lauryl sulfate and sodium ethoxylated higher fatty alcohol sulfate, with phosphate or non-phosphate builders, and corresponding nonionic compositions based on condensation products of higher fatty alcohols and ethylene oxide, such as Neodol 45-11, may be substituted for the sodium linear tridecylbenzene sulfonate formula of Example 2. The proportions of components may be varied within the ranges given in the preceding specification, and the only post-added materials may be the colorant medium and perfume. Also, instead of perfuming spray dried detergent composition globules of the described particle sizes, particulate components of detergent compositions may be colored by the described procedures and may by mixed with other particulate components of final detergent compositions to make speckled products. The concept of the invention may be applied to making other speckled particulate materials, such as salts, e.g., sodium chloride, sodium sulfate, sodium carbonate, sodium tripolyphosphate; natural materials, such as ground wood; insecticidal granules; fertilizers; synthetic organic polymeric plastics, such as polystyrene beads or hollow globules; and novelty and decorative items, and such materials may be of different particle sizes from the range previously given for the preferred synthetic organic detergent products. The speckling may be for decorative purpose or may give the product a novelty effect, and sometimes it will serve as an identifying means or a warning of the presence of a certain type of product (as in the case of poisonous materials, such as insecticides). For best results, when the substrate is not alkaline, it is desirable to pre-treat it with an alkaline material, such as sodium carbonate or sodium hydroxide.

The invention has been described with respect to various illustrations and embodiments thereof but is not to be limited to these because it is evident that one of skill in the art, with the present specification before him, will be able to utilize substitutes and equivalents without departing from the invention.

What is claimed is:

1. A process for manufacturing a particulate detergent composition which is speckled in appearance, which comprises spraying a surface of a bed of alkaline detergent composition particles with an aqueous coloring medium comprising effective amount of water, colorant and polyacrylic acid, so that the coloring medium colors less than 10% of the particles and penetrates less than 10% of the distance through the bed of particles, whereby a coherent colored surface section of detergent composition particles is formed, and breaking up such colored surface section and mixing the colored particles therefrom with the uncolored particles.

2. A process according to claim 1 wherein the polyacrylic acid is of a molecular weight in the range of 10,000 to 100,000, the content thereof in the coloring medium is in the range of 0.5 to 15%, the detergent composition particles are spray dried built synthetic organic detergent composition beads built with an alkaline builder salt, and the surfaces of the beads are uniformly colored by the colorant.

3. A process according to claim 2 wherein the polyacrylic acid is of a molecular weight in the range of 40,000 to 80,000, the colorant is a phthalocyanine or anthraquinone dye, the coloring medium is an aqueous solution comprising 0.5 to 5% of such dye, 2 to 10% of the polyacrylic acid, 1 to 5% of propylene glycol and 80 to 96.5% of water, the spray dried detergent composition beads contain 10 to 40% of alkaline builder salt(s) which is/are sodium salt(s), and such detergent composition beads are of particle sizes in the range of No's. 8 to 120, U.S. Sieve Series (0.13 to 2.4 mm.).

4. A process according to claim 3 wherein the coloring solution is sprayed onto the bed of detergent composition beads from a spray nozzle or nozzles located above a conveyer belt, which transports the beads past the spray nozzle(s).

5. A process according to claim 4 wherein the coloring solution is pumped through the spray nozzle(s) by a variable discharge pump, the discharge from which is regulated so as to be proportional to the weight of detergent composition particles on a weigh-belt and the speed of such belt, and the conveyer belt passing under the spray nozzle(s) is such a weigh-belt.

6. A process according to claim 5 wherein the weight of coloring solution sprayed onto the base detergent composition particles is in the range of 0.1 to 2% of the weight of such particles.

7. A process according to claim 6 wherein the polyacrylic acid is of a molecular weight averaging about 60,000, the colorant is an anthraquinone dye, the coloring medium is an aqueous solution comprising about 2% of such dye, about 4% of the polyacrylic acid, about 4% of propylene glycol and about 90% of deionized water, and the coloring solution is sprayed in a spray which extends transversely across less than the width of the bed of detergent composition particles on the weigh-belt on which detergent composition particles are conveyed under the spray nozzles, with the proportion of weight of coloring solution to weight of detergent composition particles being in the range of 0.1 to 1%, by weight.

8. A process according to claim 7 wherein the proportion of coloring spray to detergent composition particles is about 0.4% by weight, and the spray extends transversely across 10 to 95% of the width of the bed of particles on the belt.

9. A process according to claim 8 wherein no external heat is applied to the dyed detergent composition beads to dry them after application thereto of the spray of colorant solution, and breaking up of the colored surface section of the bed of detergent composition particles and mixing of the colored and uncolored particles are carried out while such particles are being tumbled in a perfuming apparatus.

10. A process according to claim 1 wherein the proportions of coloring spray to detergent composition particles is in the range of 0.1 to 1%, by weight, the coloring solution is sprayed onto the bed of detergent composition particles from a spray nozzle of nozzles located above a conveyer belt which transports the beads past the spray nozzle(s), the spray extends transversely across 10 to 95% of the width of the bed of particles on the belt, and the particles are spray dried built detergent beads, built with alkaline sodium builder salt, and are of particle sizes in the range of No's. 8 to 120, U.S. Sieve Series.

11. A process according to claim 1 wherein no external heat is applied to the dyed detergent composition particles to dry them after application thereto of the spray of aqueous coloring medium, and breaking up of the colored surface section of detergent composition particles and mixing of the colored and uncolored particles are carried out while such particles are being tumbled in a perfuming apparatus.

* * * * *